US005373968A

United States Patent [19]

Nelson

[11] Patent Number: 5,373,968

[45] Date of Patent: Dec. 20, 1994

[54] HOLDER FOR A WOUND COLLAPSIBLE TUBE

[76] Inventor: Monte G. Nelson, 170 E. 100 South, American Fork, Utah 84003

[21] Appl. No.: 214,195

[22] Filed: Mar. 17, 1994

[51] Int. Cl.[5] ..... B65D 35/32

[52] U.S. Cl. ..... 222/99; 222/107

[58] Field of Search ..... 222/92, 99, 100, 107, 222/215; 383/89, 90, 91; 24/306, 442, 543, 563

[56] References Cited

U.S. PATENT DOCUMENTS

| | | | |
|---|---|---|---|
| 2,862,647 | 12/1958 | Dietz | 222/99 |
| 2,903,162 | 9/1959 | Regan | 222/99 |
| 4,653,670 | 3/1987 | Kendrick | 222/99 |
| 4,759,963 | 7/1988 | Uso, Jr. et al. | 24/442 |
| 4,807,782 | 2/1989 | Meinerding et al. | 222/107 X |
| 5,108,008 | 4/1992 | Ryder | 222/99 |

FOREIGN PATENT DOCUMENTS

| | | | |
|---|---|---|---|
| 1037849 | 9/1953 | France | 222/99 |
| 418394 | 10/1934 | United Kingdom | 222/99 |

*Primary Examiner*—Kevin P. Shaver

*Attorney, Agent, or Firm*—Brady, O'Boyle & Gates

[57] ABSTRACT

A holder for a wound collapsible tube wherein a strip of non-resilient, non-elastic, flexible fabric is positioned in the center of a rolled up tube, the strip having protruding end portions which are folded over the unwound portions of the tube and fastened together to keep the rolled-up portion from unwinding. The medial portion of the fabric strip is provided with a reinforcing member to rigidify the medial portion of the fabric strip to thereby provide a mandrel to facilitate the winding of the tube around the fabric strip.

3 Claims, 1 Drawing Sheet

HOLDER FOR A WOUND COLLAPSIBLE TUBE

BACKGROUND OF THE INVENTION

Various viscous fluid material, such as, toothpaste, medicaments, grease, and the like, are packaged in collapsible tubes having a dispensing end and a crimped closed end. The material is dispensed from the tube by manually squeezing the tube adjacent its closed end, and winding the tube in a direction from the closed end to the dispensing end to progressively collapse the tube wall.

With the introduction of collapsible tubes made of plastic, there has been a tendency for the tubes to return to the original un-collapsed state resulting in the tube unwinding itself, thus requiring a rewinding of the tube to dispense additional material therefrom.

Various holders have been proposed, as disclosed in U.S. Pat. No. 4,807,782 dated Feb. 28, 1989, for holding a wound or rolled up collapsible tube to prevent it from unwinding; such as, a resilient metal strip which is positioned in the center of the rolled-up tube, the strip having protruding ends which are folded over the unwound portion of the tube to keep the rolled up portion from unwinding.

In lieu of the resilient metal strip, it has been proposed to use an elastic rubber band, wherein the lower end portion of the tube is rolled up and is held in place by the rubber band which extends through the center of the roll and across the opposing face of the tube.

SUMMARY OF THE INVENTION

To overcome the disadvantage experienced by theretofore employed wound tube holders, the holder of the present invention has been devised, and comprises, essentially, a strip of non-resilient, non-elastic, flexible fabric having a length greater than the width of the tube. A fastening element is carried on one face of the fabric strip, and a cooperating fastening element is carried on the opposite face of the fabric strip. The fabric strip is positioned parallel to the closed end of the collapsible tube, and is rolled up in the center of the roll when the tube is wound up, and the protruding end portions of the fabric strip are folded over the unrolled tube portion, to an overlapped position relative to each other, and the fastening elements are connected to each other to hold the fabric strip in a tight loop to thereby hold the rolled section. The medial portion of the strip between the end portion thereof is provided with a reinforcing member whereby the medial portion of the strip is rigidified to thereby provide a mandrel to facilitate the winding of the tube around the fabric strip.

DESCRIPTION OF THE PREFERRED EMBODIMENT

Figure 1:
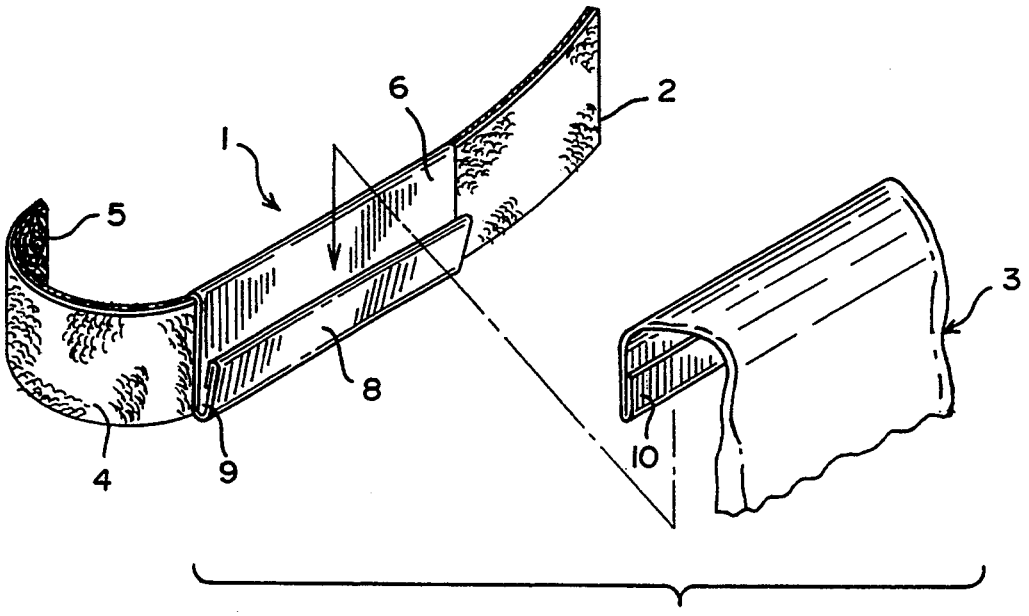
FIG. 1 is an exploded, fragmentary, perspective view showing the holder of the present invention, and the closed end of a collapsible tube.

Referring to the drawings and more particularly to FIG. 1, the holder 1 of the present invention comprises, a strip of non-resilient, non-elastic, flexible fabric 2 having a length greater than the width of a collapsible tube 3. A fastening element 4 is carried on one face of the fabric strip 2, and a cooperating fastening element 5 is carried on the opposite face of the fabric strip. The particular fastener shown is Velcro ®, wherein fastening element 4 consists of a plurality of hooks, and fastening element 5 consists of a plurality of loops.

Figure 2:
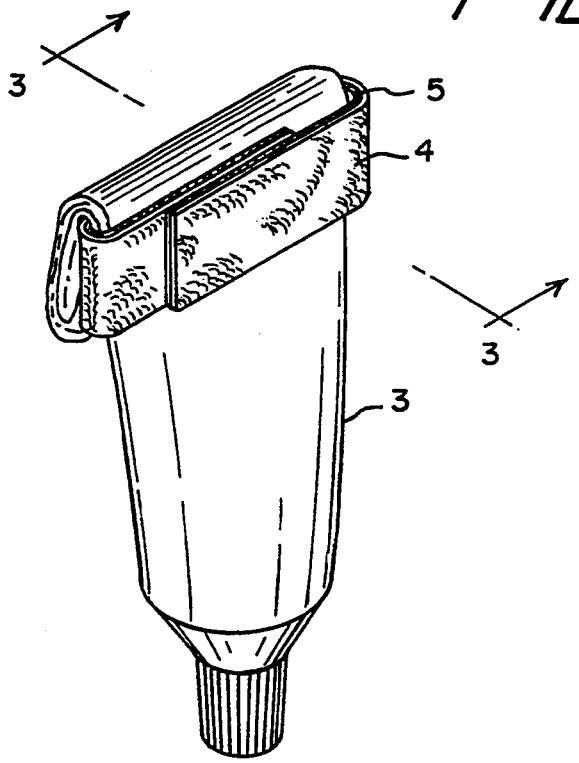
FIG. 2 is a perspective view showing the holder of the present invention in the operative position on a rolled-up collapsible tube.
Figure 3:
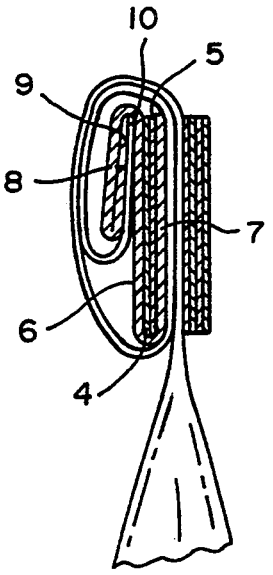
FIG. 3 is a view taken along line 3—3 of FIG. 2.

The medial portion of the fabric strip 2 is reinforced by a reversely bent metallic member 6 having one portion bent around and gripping the fabric strip 2, and another portion 8 providing a groove or recess 9 for receiving the crimped closed end 10 of the collapsible tube 3. In use, the crimped, closed end 10 of the collapsible tube 3 is inserted into the recess 9 of the metallic member 6, as indicated in FIG. 1. The metallic member 6 now functions as a mandrel so that the collapsible tube 3 can be manually wound thereon as shown in FIGS. 2 and 3. As the tube 3 is wound around the metallic member 6, the wall of the tube becomes squeezed to the collapsed position while the material is dispensed from the tube. After the desired amount of material has been dispensed from the tube, the opposite ends of the fabric strip 2 are folded to an overlapped position as shown in FIG. 2, against the surface of the wall of the unwound portion of the tube, and the overlapped portions of the strip 2 are pressed together to interconnect the hook portion 4 and the loop portion 5 of the fastener, to thereby tightly hold the rolled up portion of the tube whereby the tube is prevented from unwinding.

To dispense additional material from the tube 3, the overlapped portions of the fabric strip 2 are pulled away from each other, and the tube 3 can be wound further around the strip 2 which is then fastened as noted above.

From the above description, it will be readily apparent to those skilled in the art that the holder of the present invention is an improvement over prior known holders since the metal reinforced, non-elastic, non-resilient flexible fabric strip 2, and associated fastener, of the present invention can be easily connected to a collapsible tube, and used as a mandrel to wind the collapsible tube thereon. The flexible fabric being non-resilient and non-elastic, results in a holder which can be used over an extended period of time without its holding feature being diminished.

It is to be understood that he form of the invention herewith shown and described is to be taken as a preferred example of the same, and that various changes in the shape, size and arrangement of parts may be resorted to without departing from the spirit of the invention or scope of the subjoined claim.

I claim:

1. In combination, a holder and a collapsible tube having a closed end and a dispensing end, said holder comprising a strip of non-resilient, non-elastic flexible fabric, said fabric having a length greater than the width of the collapsible tube, a fastening element carried on one face of said fabric strip, a cooperating fastening element carried on the opposite face of said fabric strip, said fabric strip being positioned parallel and adjacent to the closed end of the collapsible tube, the collapsible tube being wound around the medial portion of the fabric strip, a reinforcing member secured to the medial portion of the flexible fabric strip between the opposite end portions thereof, to thereby rigidify the medial portion of the fabric strip to provide a mandrel to facilitate the winding of the tube around the fabric strip, the opposite end portions of the fabric strip being folded over the unrolled tube portion to an overlapped position relative to each other, said fastener elements being connected to each other to hold the fabric strip in a tight loop against the surface of the unwound portion of the tube, whereby the rolled-up collapsible tube is prevented from unwinding.

2. The combination of a holder and collapsible tube as defined in claim 1, wherein the fastening element carried on said one face of said fabric strip comprises a plurality of hook members, and the fastening element carried on the opposite face of said fabric strip comprises a plurality of loop members.

3. The combination of a holder and collapsible tube as defined in claim 1, wherein the reinforcing member comprises a reversely bent metallic member, one portion of said metallic member being bent around and gripping the medial portion of said fabric strip, another portion of said metallic member being bent to provide a recess, the closed end of said collapsible tube being inserted into said recess.

* * * * *